US005988979A

United States Patent [19]

Wang

[11] Patent Number: 5,988,979

[45] Date of Patent: Nov. 23, 1999

[54] CENTRIFUGAL BLOWER WHEEL WITH AN UPWARDLY EXTENDING, SMOOTHLY CONTOURED HUB

[75] Inventor: Jui-Shang Wang, Taipei, Taiwan

[73] Assignee: Honeywell Consumer Products, Inc., Southborough, Mass.

[21] Appl. No.: 08/924,436

[22] Filed: Aug. 27, 1997

Related U.S. Application Data

[63] Continuation of application No. 08/660,656, Jun. 4, 1996, abandoned.

[51] Int. Cl.[6] ..... F04D 29/30

[52] U.S. Cl. ..... 416/178; 416/186 R; 416/187; 416/188; 416/200 R

[58] Field of Search ..... 416/178, 186 R, 416/187, 188, 235, 200 R

[56] References Cited

U.S. PATENT DOCUMENTS

| | | | |
|---|---|---|---|
| 2,231,063 | 2/1941 | Evans . | |
| 2,418,012 | 3/1947 | Chester | 416/187 |
| 2,463,976 | 3/1949 | Kilchenmann | 416/188 |
| 2,652,190 | 9/1953 | Meltzer et al. . | |
| 2,803,398 | 8/1957 | Sprouse | 416/187 |
| 2,991,004 | 7/1961 | Denbo et al. | 416/188 |
| 3,165,258 | 1/1965 | Wentling et al. . | |
| 3,257,071 | 6/1966 | Harris . | |
| 3,358,913 | 12/1967 | Beesley . | |
| 3,394,876 | 7/1968 | Eck . | |
| 3,450,337 | 6/1969 | Jolette | 416/178 |
| 3,846,043 | 11/1974 | Wolbrink et al. . | |
| 4,324,529 | 4/1982 | Nickels . | |
| 4,647,271 | 3/1987 | Nagai et al. | 416/186 R |
| 4,738,593 | 4/1988 | Reifschneider . | |
| 4,820,115 | 4/1989 | Bandukwalla | 416/188 |
| 5,266,007 | 11/1993 | Bushnell et al. . | |

*Primary Examiner*—Christopher Verdier
*Attorney, Agent, or Firm*—Loletta L. Darden

[57] ABSTRACT

A centrifugal blower wheel having an indivisible prime number of peripherally spaced blades projecting upwardly from the top surface of a generally annular-shaped base plate. Each blade includes a tapered portion extending along an inside edge of the blade to approximately ⅓ to ½ the length of the blade. A hub is centrally located on the top surface of the base plate and surrounded by the inside edges of the blades, the hub curving upwardly from the top surface of the base plate to form a smoothly contoured curve.

34 Claims, 3 Drawing Sheets

CENTRIFUGAL BLOWER WHEEL WITH AN UPWARDLY EXTENDING, SMOOTHLY CONTOURED HUB

This application is a continuation of application Ser. No. 08/660,656 filed on Jun. 4, 1996, now abandoned.

BACKGROUND OF THE INVENTION

1. Field of the Invention

The present invention relates generally to the field of centrifugal fans or blowers, and more particularly to an improved blower wheel or impeller of the type especially useful for portable room air cleaners or humidifiers.

2. Description of the Related Art

Blower wheels or impellers and methods of manufacturing the same are well known in the art and a wide variety of blowers are commercially available. Typically, portable room air cleaners and humidifiers utilize centrifugal fans to draw ambient air through the device during operation.

Single and dual input blower wheels or impellers for centrifugal fans of this type generally include an annular, rotary base plate or hub on which is mounted a plurality of peripherally-spaced, axial fan blades or vanes. A single input blower wheel has a single axial input formed by a single set of blades projecting from one side of the base plate. In contrast, a dual input blower wheel comprises two sets of blades projecting from opposite sides of the base plate, thereby forming two axial inputs. Each set of blades of the conventional dual input blower wheel is of the same length so that the distal ends of the blades are equidistant from the base plate.

Whether a single or a dual input blower wheel, the operation is generally as follows. The hub of the blower wheel is secured to the drive shaft of a driving motor, whereby the blower wheel is rotated by the motor. As a result of such rotational movement, air flow is drawn axially into the inlet(s) of the blower wheel and centrifugally discharged in a radially outward manner.

In other words, the blower wheel imparts velocity to the air travelling through the blower wheel as a result of two cooperating forces: (1) the centrifugal force caused by rotation of the air; and (2) the rotary force caused by contact between the air and the fan blades. As such, the fan blade design is an important factor in increasing the velocity and/or pressure of the air traveling through the blower.

In the fields of portable room air cleaners and humidifiers, it is especially important that the blower wheel be compact, highly reliable and efficient to move a large volume of air, while at the same time, displacing such air with a minimum amount of noise.

In an attempt to achieve these competing interests, a number of different fan blade designs have been utilized in centrifugal blower wheels. Such fan blade designs include, by way of example, radial blades that lie on radii of the hub, forward curved blades that are angularly displaced from the radial position in the direction of rotation of the blower wheel, and backward curved blades that are angularly displaced from the radial position against the direction of rotation of the blower wheel.

In addition, some fan blades are square cut, such that their inside edge projects upwardly and perpendicularly from the base plate of the blower wheel and is perpendicular to the distal end of the blade, or in some instances, may be slightly radiused where the inside edge joins the distal end of the blade. However, these square cut or modified square cut designs have a tendency to cause undesirable turbulence and noise during operation.

Still other blades have an inside edge that projects upwardly from the base plate at an angle to form a uniform taper along the entire length of the inside edge from the base plate to the distal end of the blade. However, this tapered blade design necessarily requires the blades to be wider proximate the base plate, thereby reducing the inside diameter formed by the blades proximate the base plate and limiting the relative output of the blower wheel.

In addition to the various fan blade designs, the design of the hub has also proven to be an important consideration. Bell-shaped or conical hubs have been employed with blower wheels to provide laminar, nonturbulent air flow patterns efficiently generated during the process of altering the air flow from its axial induction path to its radial discharge path. Since a large portion of the air flow leaving the hub and being discharged toward the fan blades contacts the blades at their proximal ends adjacent the hub, any nonlaminar, turbulent effect on the air flow pattern may cause undesirable noise and adversely affect the operation of the blower. Despite improvement in the air flow, however, there continues to be a need for the development of an optimal shape of the hub to improve the efficiency of the blower wheel and reduce overall noise.

SUMMARY OF THE INVENTION

Accordingly, it is an object of the present invention to provide a new and improved blower wheel or impeller having increased efficiency and a reduction in operational noise.

Another object of the present invention is to provide a new and improved blower wheel or impeller whereby the above-mentioned operational disadvantages of conventional blower wheels are overcome.

The foregoing and other objects and advantages are achieved in accordance with the present invention through the provision of a centrifugal blower wheel having a plurality of peripherally spaced blades projecting upwardly from the top surface of a generally annular-shaped base plate. Each blade includes a tapered portion extending along an inside edge of the blade from the distal end of the blade to approximately ⅓ to ½ the length of the blade.

In accordance with the invention, a hub is centrally located on the top surface of the base plate and surrounded by the inside edges of the blades, the hub curving upwardly from the top surface of the base plate to form a smoothly contoured curve defined by the formula:

$$y=(2H/R^3)x^3-(3H/R^2)x^2+H$$

where H is the height of the blower wheel and R is the radius of the blower wheel.

In a second embodiment of the invention, a dual inlet centrifugal blower wheel is provided having a first set of peripherally spaced blades projecting upwardly from a top surface of a generally annular-shaped base plate and a second set of peripherally spaced blades projecting downwardly from a bottom surface of the base plate, the first and second set of blades being offset from each other. Each of the first set of blades includes a tapered portion extending along an inside edge of the blade from the distal end of the blade to approximately ⅓ to ½ the length of the blade.

In accordance with the invention, a hub is centrally located on the top surface of the base plate and surrounded by the inside edges of the first set of blades, the hub curving upwardly from the top surface of the base plate to form a smoothly contoured curve defined by the formula:

$$y=(2H_1/R_1^3)x^3-(3H_1/R_1^2)x^2+H_1$$

where $H_1$ is the length of the first set of blades and $R_1$ is the radius of the blower wheel.

The foregoing specific objects and advantages of the invention are illustrative of those that can be achieved by the present invention and are not intended to be exhaustive or limiting of the possible advantages which can be realized. Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF THE DRAWINGS

The foregoing features and other aspects of the invention are explained in the following description taken in connection with the accompanying drawings wherein.

DESCRIPTION OF THE PREFERRED EMBODIMENTS

Figure 1:
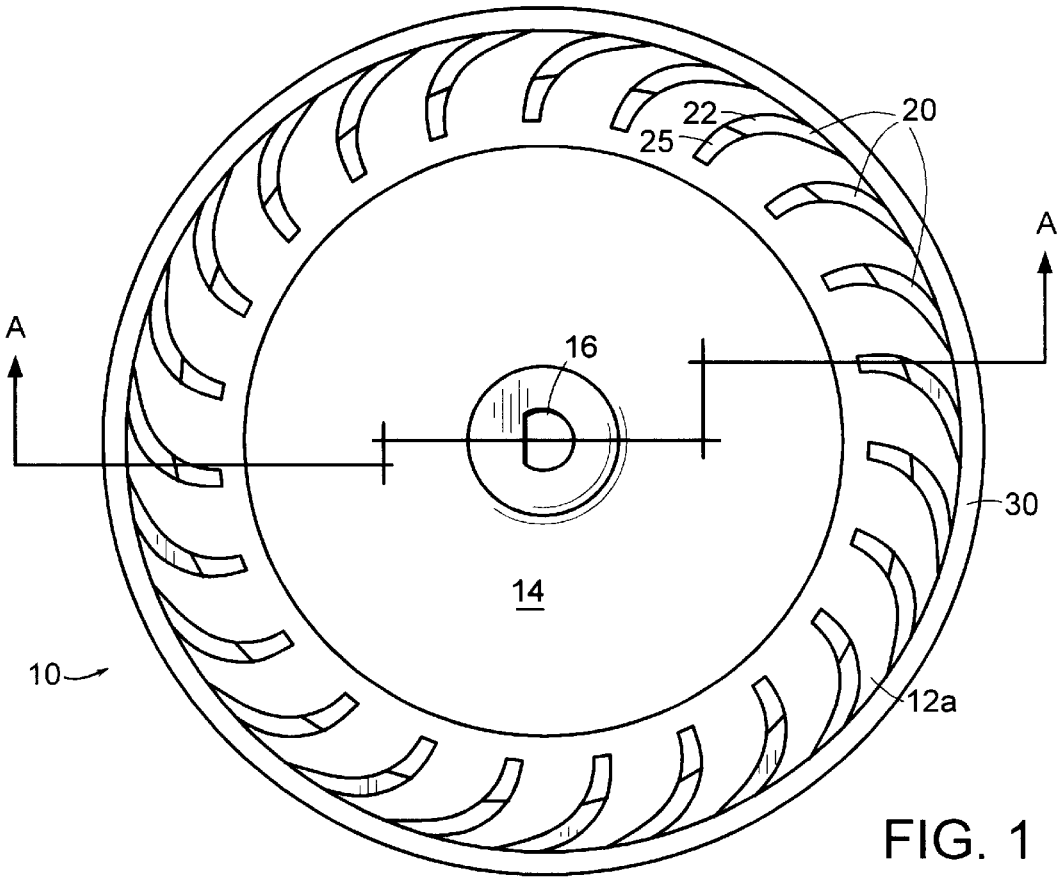
FIG. 1 is a top plan view of a single inlet blower wheel in accordance with the present invention.
Figure 2:
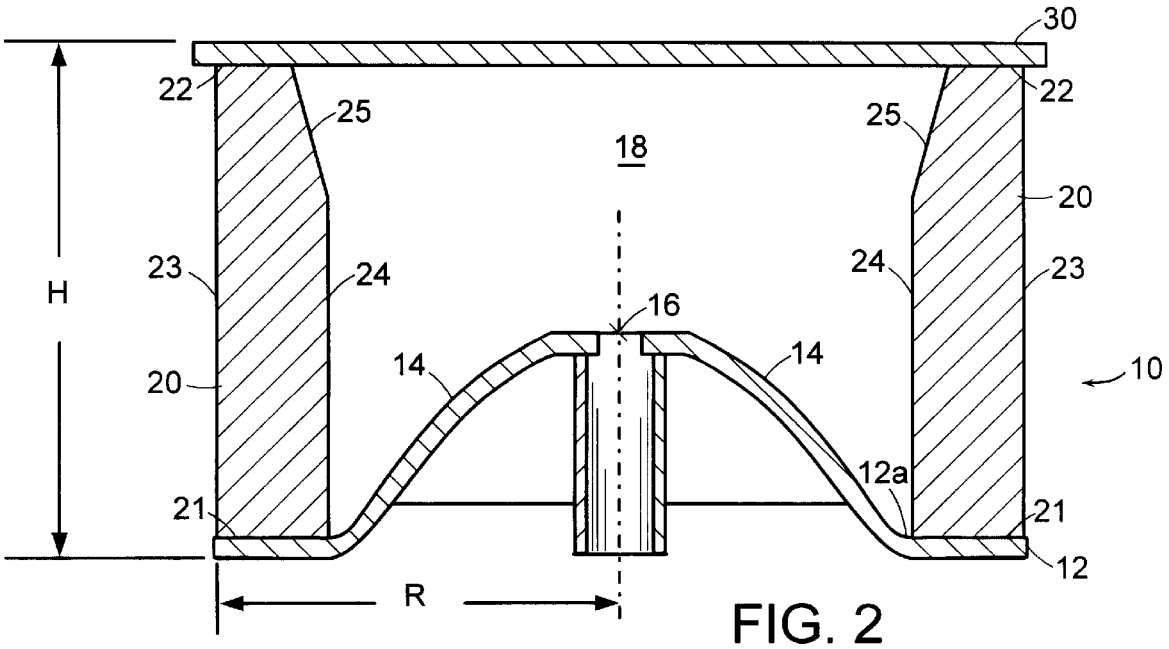
FIG. 2 is a cross-sectional view of the blower wheel illustrated in FIG. 1 as taken along line A—A of FIG. 1.

Referring to the drawings, and more specifically to FIGS. 1 and 2 thereof, there is illustrated a single inlet centrifugal blower wheel or impeller 10 comprising a generally annular-shaped base plate 12. A plurality of peripherally-spaced, axial fan blades or vanes 20 are preferably formed integrally with and project upwardly from the top surface of the base plate 12. In the illustrated embodiment, the blades 20, are angularly related and are suitably curved so as to provide centrifugal flow. The outside edge 23 of the blades 20 forms the circumferential sides of the blower wheel 10, with each blade 20 having a proximal end 21 attached to the base plate 12 and a distal end 22 retained by an annular end ring 30.

The inside edge 24 of the blades 20 form the axial inlet 18 through which air is drawn into the blower wheel 10 during operation. The inside edge 24 of the blades 20 is tapered 25 proximate the distal end 22 of the blade 20, which taper 25 preferably extends along the inside edge 24 from the distal end 22 to approximately ⅓ to ½ the length of the blade 20. It has been found that such a taper 25 reduces undesirable turbulence and noise during operation. In addition, because the diameter of the axial inlet 18 to the blower wheel 10 is enlarged due to the taper 25, greater air flow through the inlet 18 is provided without increasing the overall size of the blower wheel 10.

The base plate 12 also carries a hub 14 which is preferably integrally molded into the base plate 12 at the time of manufacturing the blower wheel 10. As illustrated in FIGS. 1 and 2, the hub 14 is centrally located on the top surface 12*a* of the base plate 12 and is surrounded by the inside edge 24 of the blades 20. The hub 14 is provided with an axial bore 16 for receiving the shaft of a motor (not shown) for driving the blower wheel 10.

In order to provide an improved laminar, nonturbulent air flow pattern and to increase the centrifugal output of the blower wheel 10 in accordance with the present invention, the hub 14 curves upwardly from the top surface 12*a* of the base plate 12 to form a smoothly contoured bell-shaped or frusto-conical configuration. The smoothly contoured complex curve of the hub 14 is defined by the following formula:

$$y=(2H/R^3)x^3-(3H/R)x^2+H$$

where H=the height of the blower wheel 10 and R=the radius of the blower wheel 10.

The curved hub 14 defined by the above-mentioned formula has proven effective in minimizing low pressure areas between the blades 20, increasing the radial (centrifugal) air flow exhausted from the blower wheel 10 and decreasing the overall operational noise of the blower wheel 10.

It has also been found that use of an indivisible prime number of blades 20 on the blower wheel 10 avoids undesirable vibration and/or resonance frequencies. It is understood, however, that the number of blades 20 on the blower wheel 10 is a function of the diameter (2R) of the base plate 12 and that the optimum number of blades 20 can be determined in a conventional manner. As such, it is understood that the drawings are intended to illustrate the preferred embodiment of the present invention without necessarily limiting the number of blades 20 or the size of the blower wheel 10.

Figure 3:
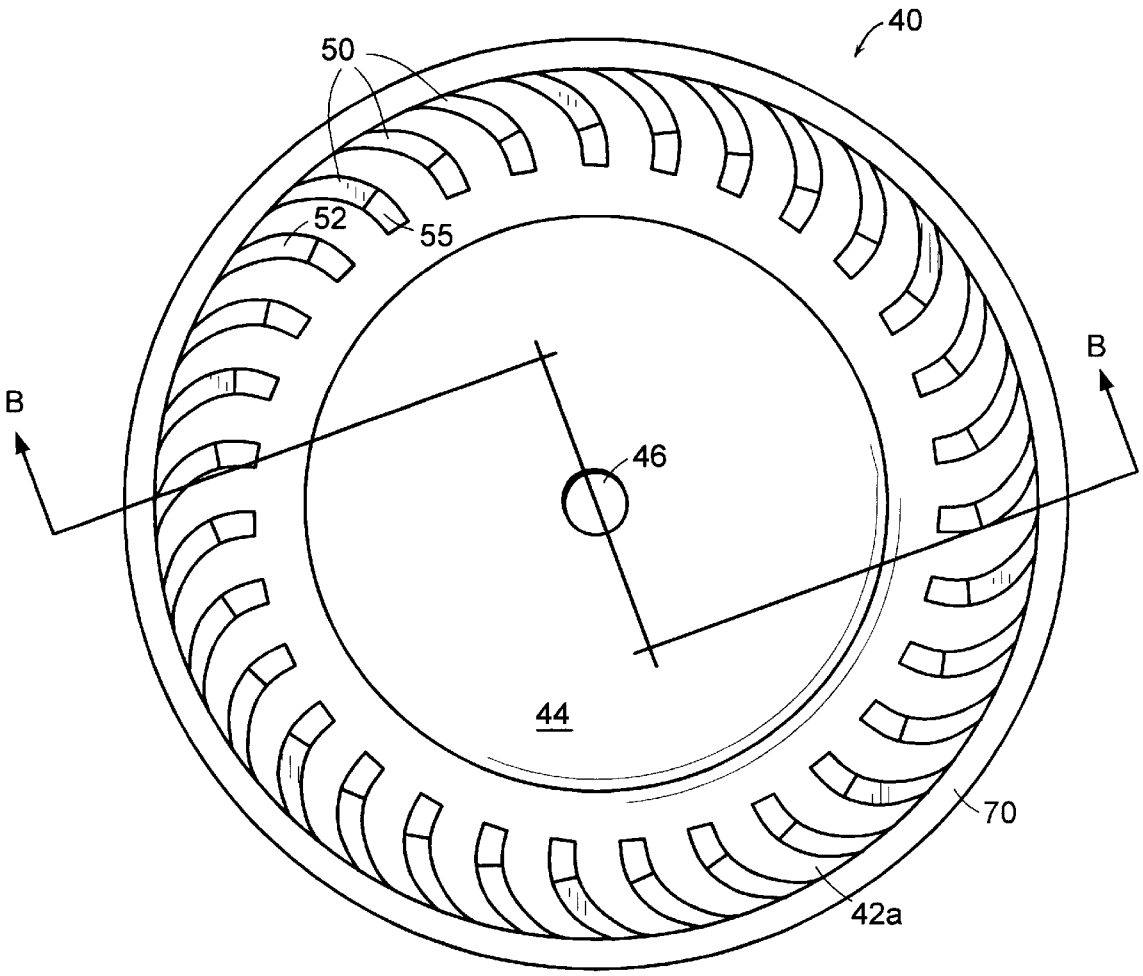
FIG. 3 is a top plan view of a dual inlet blower wheel in accordance with the present invention.
Figure 4:
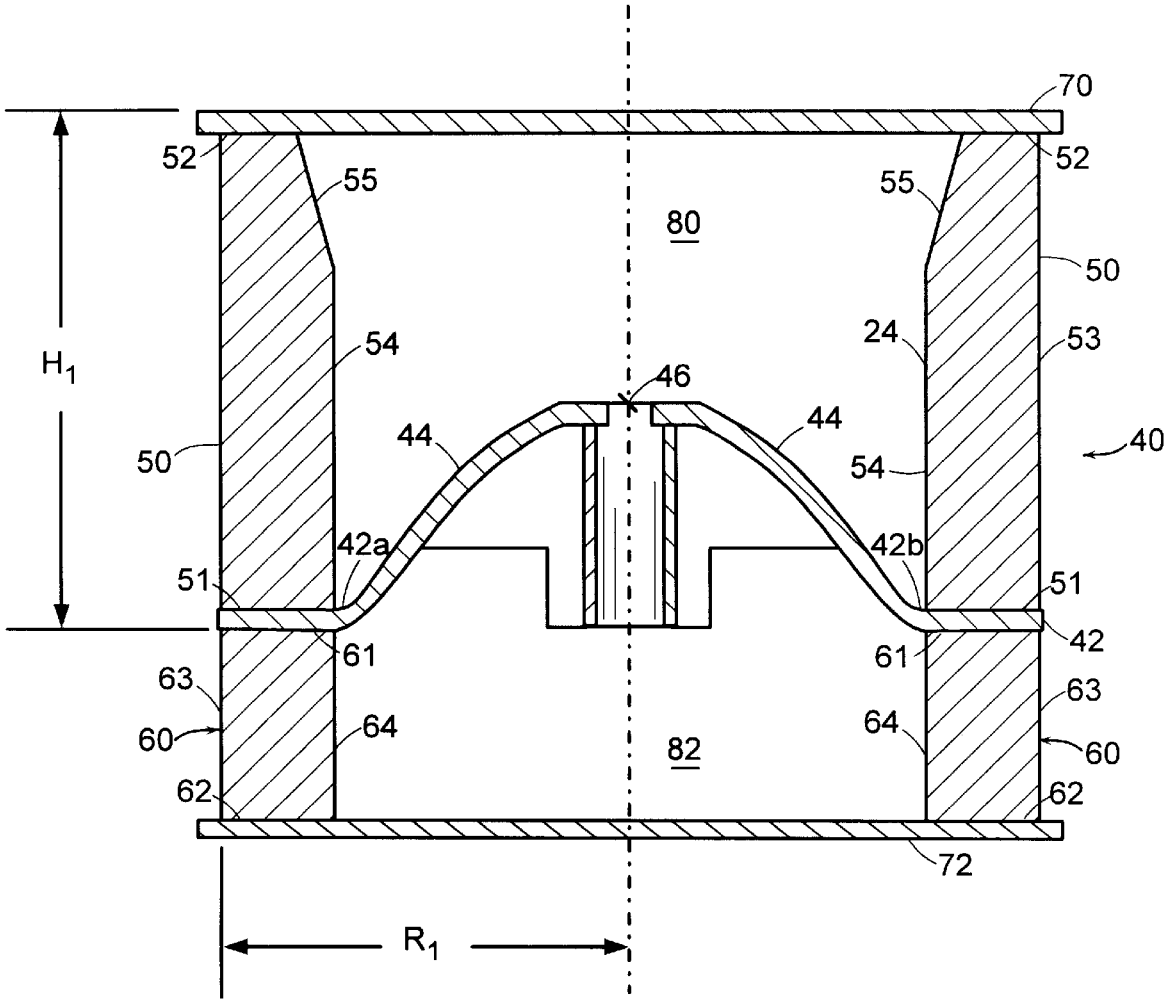
FIG. 4 is a cross-sectional view taken along line B—B of the blower wheel illustrated in FIG. 3.

Referring now to FIGS. 3 and 4, a second embodiment of the present invention is illustrated. In accordance with this second embodiment, there is shown a dual inlet centrifugal blower wheel or impeller 40 comprising a generally annular-shaped base plate 42. The base plate 42 is formed with two opposing sets of peripherally-spaced, axial fan blades or vanes 50, 60 projecting from opposite surfaces of the base plate 42. The blades 50, 60 are preferably formed integrally with the base plate 42. The outside edges 53, 63 of the blades 50, 60 form the circumferential sides of the blower wheel 40.

The first set of blades 50 project upwardly from the top surface 42*a* of the base plate 42 and are similar to the blades 20 described above with respect to the single inlet centrifugal blower wheel 10. The blades 50 are angularly related and are suitably curved so as to provide centrifugal flow, with each blade 50 having a proximal end 51 attached to the base plate 42 and a distal end 52 retained by an annular end ring 70.

The inside edge 54 of the blades 50 form a first axial inlet 80 through which air is drawn into the blower wheel 40 during operation. Like the blades 20 of the above-described single inlet centrifugal blower wheel 10, the inside edge 54 of the blades 50 are tapered 55 proximate the distal end 52 of the blade 50, which taper 55 preferably extends along the inside edge 54 from the distal end 52 to approximately ⅓ to ½ the length of the blade 50. It has been found that such a taper 55 reduces undesirable turbulence and noise during operation. In addition, because the diameter of the axial inlet 80 to the blower wheel 40 is enlarged due to the taper 55, greater air flow through the inlet 80 is provided without increasing the overall size of the blower wheel 40.

The base plate 42 also carries a hub 44 which is preferably integrally molded to top surface 42*a* of the base plate 42 at the time of manufacturing the blower wheel 40. As illustrated, the hub 44 is centrally located on the top surface 42*a* of the base plate 42 and is surrounded by the inside edge 44 of the blades 50. The hub 44 is provided with an axial bore 46 for receiving the shaft of a motor (not shown) for driving the blower wheel 40.

Like the hub 14 of the single inlet centrifugal blower wheel 10, the hub 44 of blower wheel 40 similarly curves upwardly from the top surface 42*a* of the base plate 42 to form a smoothly contoured bell-shaped or frusto-conical configuration. The smoothly contoured complex curve of the hub 44, which provides an improved laminar, nonturbulent air flow pattern and increases the centrifugal output of the blower wheel 40, is defined by the following formula:

$$y=(2H_1/R_1^3)x^3-(3H_1/R_1^2)x^2+H_1$$

where $H_1$=the height of the upper portion of the blower wheel 40 and $R_1$=the radius of the blower wheel 40.

The curved hub 44 defined by the above-mentioned formula has proven effective in mninimizing low pressure areas between the blades 50, increasing the radial (centrifugal) air flow exhausted from the dual inlet blower wheel 40 and decreasing the overall operational noise of the blower wheel 40.

In accordance with the present invention, the lower surface 42*b* of the base plate 42 has a second set of peripherally spaced, blades 60 integrally formed thereon that project downwardly from the base plate 42. The blades 60 have a proximal end 61 attached to the base plate 42 and a distal end 62 retained by a second annular end ring 72. The blades 60 may be straight or suitably curved to provide centrifugal flow during operation depending upon the particular application.

The inside edge 64 of the blades 60 form a second axial inlet 82 through which air is drawn into the blower wheel 40 and radially or centrifugally exhausted through blades 60 during operation.

Frequently, the blower wheel 40 will be mounted within an enclosure, such as a housing for a portable room air cleaner or humidifier (not shown). Due to design constraints, it is often desirable to position the blower wheel 40 proximate a wall of the housing (not shown) so that the distal end 62 of blades 60 are proximate the wall.

In operation, however, the volume of air drawn into the inlet 82 is generally lower than that drawn into inlet 80. In order to load balance or equalize the volume and velocity of the air exhausted along the entire length of the blades 50, 60 on both sides of the base plate 42, the second set of blades 60 are preferably shorter than the first set of blades 50 projecting upwardly from the opposite surface of the base plate 42. That is, the base plate 42 is asymmetrically located between the distal ends 52, 62 of the blades 50, 60.

According to the present invention, the second set of blades 60 are also offset (e.g., not aligned or collinear) from the first set of blades 50 in order to balance the blower wheel 40 and minimize heavy spots.

It has also been found that use of an indivisible prime number of blades 50, 60 on the blower wheel 40 avoids undesirable vibration and/or resonance frequencies. It is understood, however, that the number of blades 50, 60 on the blower wheel 40 is a function of the diameter ($2R_1$) of the base plate 42 and that the optimum number of blades 50, 60 can be determined in a conventional manner. As such, it is understood that the drawings are intended to illustrate the present invention without necessarily limiting the number of blades 50, 60 or the size of the blower wheel 40.

It is understood that the present invention is applicable to both single inlet and dual inlet blower wheels. The blower wheels 10, 40 are preferably molded in one piece in a conventional manner from a suitable plastic material. It is understood, however, that the present invention may also be assembled using separate components and/or other suitable materials.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used herein as terms of description and not terms of limitation. There is no intention to use the terms or expressions to exclude any equivalents of features shown and described or portions thereof and this invention should be defined in accordance with the claims which follow.

I claim:

1. A centrifugal blower wheel having a height and a radius, comprising:

(a) a generally annular-shaped base plate having a top and bottom surface;

(b) a plurality of uniformly spaced fan blades mounted on the perimeter of the top surface of the base plate, the fan blades projecting upwardly from the top surface of the base plate;

(c) a hub centrally located on the top surface of the base plate and surrounded by the blades, the hub curving upwardly from the top surface of the base plate to form a smoothly contoured curve defined by the formula:

$$y=(2H/R^3)x^3-(3H/R^2)x^2+H$$

where H is the height of the blower wheel and R is the radius of the blower wheel.

2. The centrifugal blower wheel according to claim 1, wherein each of the blades comprises a proximal end attached to the top surface of the base plate, a distal end opposite thereto, an outside edge and an inside edge, the distance between the proximal and distal ends defining a length of the blade, and wherein the inside edge is tapered proximate the distal end of the blade.

3. The centrifugal blower wheel according to claim 2, wherein the taper extends along the inside edge from the distal end to approximately ⅓ to ½ the length of the blade.

4. The centrifugal blower wheel according to claim 1, wherein the hub is integrally formed in the base plate.

5. The centrifugal blower wheel according to claim 1, wherein the blades are integrally formed in the base plate.

6. The centrifugal blower wheel according to claim 1, wherein the hub comprises an axial bore for receiving a drive shaft.

7. The centrifugal blower wheel according to claim 1, wherein the blades are angularly related and curved to provide centrifugal flow.

8. The centrifugal blower wheel according to claim 1, wherein the outside edge of the blades forms circumferential sides of the blower wheel.

9. The centrifugal blower wheel according to claim 1, further comprising an annular end ring for retaining the distal end of the blades.

10. The centrifugal blower wheel according to claim 1, wherein an indivisible prime number of blades are mounted on the perimeter of the top surface of the base plate.

11. A cylindrical blower wheel comprising:

(a) a generally annular-shaped base plate having a top and bottom surface;

(b) a first set of uniformly spaced fan blades mounted on the perimeter of the top surface of the base plate, the first set of blades projecting upwardly from the top surface of the base plate from a proximal end of the blades to a distal end thereof;

(c) a hub centrally located on the top surface of the base plate and surrounded by the first set of blades, the hub curving upwardly from the top surface of the base plate to form a smoothly contoured curve defined by the formula:

$$y=(2H_1/R_1^3)x^3-(3H_1/R_1^2)x^2+H_1$$

where $H_1$ is a distance between the top surface of the base plate and the distal end of the first set of blades and $R_1$ is a radius of the blower wheel.

12. The blower wheel according to claim 11, further comprising a second set of uniformly spaced fan blades mounted on the perimeter of and projecting downwardly from the bottom surface of the base plate, the second set of blades having an inner edge, an outer edge, a proximal end mounted to the bottom surface of the base plate, and a distal end opposite thereto.

13. The blower wheel according to claim 11, wherein each of the first set of blades comprises an outside edge and an inside edge, the distance between the proximal and distal ends defining a length of the first set of blades, and wherein the inside edge of the first set of blades comprises a first tapered portion proximate the distal end of the first set of blades.

14. The blower wheel according to claim 13, wherein the first tapered portion extends along the inside edge of the first set of blades from the distal end to approximately ⅓ to ½ the length of the first set of blades.

15. The blower wheel according to claim 11, wherein the hub is integrally formed in the base plate.

16. The blower wheel according to claim 11, wherein the first set of blades are integrally formed in the base plate.

17. The blower wheel according to claim 12, wherein the second set of blades are integrally formed in the base plate.

18. The blower wheel according to claim 11, wherein the hub comprises an axial bore for receiving a drive shaft.

19. The blower wheel according to claim 11, wherein the first set of blades are angularly related and curved to provide centrifugal flow.

20. The blower wheel according to claim 12, wherein the second set of blades are angularly related and curved to provide centrifugal flow.

21. The blower wheel according to claim 12, wherein the outside edges of the first and second set of blades form circumferential sides of the blower wheel.

22. The blower wheel according to claim 11, further comprising a first annular end ring for retaining the distal ends of the first set of blades.

23. The blower wheel according to claim 12, further comprising a second annular end ring for retaining the distal ends of the second set of blades.

24. The blower wheel according to claim 11, wherein the first set of blades comprises an indivisible prime number of blades mounted on the perimeter of the top surface of the base plate.

25. The blower wheel according to claim 12, wherein the second set of blades comprises an indivisible prime number of blades mounted on the perimeter of the bottom surface of the base plate.

26. The blower wheel according to claim 12, wherein the first and second set of blades are offset from one another.

27. The blower wheel according to claim 12, wherein the distance between the proximal and distal ends of the second set of blades defines a length of the second set of blades, and wherein the inner edge of the second set of blades comprises a second tapered portion proximate the distal end of the second set of blades.

28. The blower wheel according to claim 27, wherein the second tapered portion extends along the inner edge of the second set of blades from the distal end thereof to approximately ⅓ to ½ the length of the second set of blades.

29. The blower wheel according to claim 27, wherein the length of the second set of blades is less than the length of the first set of blades.

30. A dual inlet centrifugal blower wheel, comprising:

(a) a generally annular-shaped base plate having a top and bottom surface;

(b) a first set of peripherally spaced fan blades mounted on and projecting upwardly from the top surface of the base plate, the first set of blades having a proximal end mounted to the top surface and a distal end opposite thereto, the proximal and distal ends defming a length of the first set of blades, each of the first set of blades having a tapered portion extending along an inside edge of each blade to approximately ⅓ to ½ the length of the first set of blades;

(c) a second set of peripherally spaced fan blades mounted on and projecting downwardly from the bottom surface of the base plate; and (d) a hub centrally located on the top surface of the base plate and surrounded by the inside edges of the first set of blades, the hub curving upwardly from the top surface of the base plate to form a smoothly contoured curve defined by the formula:

$$y=(2H_1/R_1^3)x^3-(3H_1/R_1^2)x^2+H_1$$

where $H_1$ is the length of the first set of blades and $R_1$ is a radius of the blower wheel.

31. The dual inlet centrifugal blower wheel according to claim 30, wherein the first set of blades are offset from the second set of blades.

32. The dual inlet centrifugal blower wheel according to claim 30, wherein the second set of blades have a length that is less than the length of the first set of blades.

33. The dual inlet centrifugal blower wheel according to claim 30, wherein the first and second sets of blades are angularly related and curved to provide centrifugal flow.

34. The dual inlet centrifugal blower wheel according to claim 30, wherein the first and second sets of blades comprise an indivisible prime number of blades, respectively.

* * * * *